United States Patent [19]

Demuth

[11] Patent Number: 4,984,395

[45] Date of Patent: Jan. 15, 1991

[54] GRINDING DEVICE AND METHOD FOR GRINDING CARD CLOTHING

[75] Inventor: Robert Demuth, Nurensdorf, Switzerland

[73] Assignee: Rieter Machine Works, Ltd., Winterthur, Switzerland

[21] Appl. No.: 285,122

[22] Filed: Dec. 16, 1988

[30] Foreign Application Priority Data

Dec. 24, 1987 [CH] Switzerland ..... 05056/87

[51] Int. Cl.[5] ..... B24B 19/18

[52] U.S. Cl. ..... 51/242; 51/251; 51/289 R

[58] Field of Search ..... 51/242, 243, 251, 252, 51/253, 241 R, 281 R, 289 R

[56] References Cited

U.S. PATENT DOCUMENTS 294,962 3/1884 Brierley ..... 51/242

4,327,525 5/1982 Ennis ..... 51/242

4,575,972 3/1986 Ohki et al. ..... 51/242

FOREIGN PATENT DOCUMENTS 2365924 1/1967 Fed. Rep. of Germany .

0342863 11/1959 Switzerland .

*Primary Examiner*—Roscoe V. Parker

*Attorney, Agent, or Firm*—Kenyon & Kenyon

[57] ABSTRACT

The grinding device is constructed with a grinding member which is biased elastically against the teeth of the clothing of a carding machine during operation of the machine. During grinding, the grinding member is capable of three degrees of freedom of movement under the elastic biasing force. In one embodiment, individual grinding stones are used as the grinding members. In another embodiment, an elongated flexible belt having a grinding coating is used as the grinding member and is biased by means of a tube containing pressurized fluid.

23 Claims, 3 Drawing Sheets

GRINDING DEVICE AND METHOD FOR GRINDING CARD CLOTHING

This invention relates to a grinding device and a method for grinding card clothing.

As is known, carding machines have been constructed with elements having a clothing of teeth for conveying a web of material. It is also well known that during spinning, the teeth forming the clothing slowly wear out during operation of the carding machine with the points of the teeth becoming blunt. As a result, the carding machine operation suffers and the web quality deteriorates.

Thus, it has been conventional to grind the teeth of a card clothing from time to time in order to restore the required sharpness to the points of the teeth. However, in many cases, this has resulted in the carding machine being taken out of operation in order to permit grinding of the teeth. Thus, the machine is at a standstill for some time. In addition, the grinding machinery frequently employs a grinding roller and a support which must be very stable and be made with extreme precision. As a result, the grinding operation itself becomes expensive. Still further, the teeth of the clothing are not always ground by different amounts. Still further, the wearing out of the points of the teeth also results in a slow and continuous deterioration in web quality. Considered over a relatively long period of time, the changes in the resulting web are such that the quality slowly decreases and then abruptly improves after each grinding operation. Thus, it has been difficult to make a yarn of a constant quality when considered over both short and long periods of operation of the carding machine.

Various types of servicing attachments have also been known for employing a grinding wheel on a carding machine, for example as described in U.S. Pat. No. 4,327,525. In this case, a grinding wheel is mounted on a fixed axis of rotation and is disposed over the card clothing of a carding machine roller so as to grind the teeth of the card clothing.

Spanish patent No. 250,111 also describes the use of a grinding means to grind the clothing of a rotary cylinder. In this case, the grinding means is pressed against the cylinder by a spring and is reciprocated along the cylinder.

In both of the above-noted examples, the rollers used for grinding generally have a grinding coating on the outer surface. To insure optimum grinding of each tooth of a clothing during a grinding operation, that is, to insure that the amount of material removed from each tooth is neither inadequate nor excessive, the roller must satisfy very stringent requirements as to rectilinearity. This proves to be very expensive and, thus, makes the grinding process expensive. Even so, it is inevitable for an excessive or inadequate amount of material to be ground away from some teeth or parts of the teeth. This is due to the fact that the points of the teeth are not all of exactly the same height in practice. That is, the teeth do not all lie exactly on a geometric cylindrically generated surface coaxial with the axis of rotation of the cylinder.

Accordingly, it is an object of the invention to provide a grinding device which does not require precise machining and mounting arrangements.

It is another object of the invention to provide a grinding device which is able to adjust to deviations in the teeth of a clothing to be ground.

It is another object of the invention to be able to grind the teeth of a clothing equally intensively and to the same extent.

It is another object of the invention to be able to perform a grinding operation during operation of a carding machine.

It is another object of the invention to eliminate abrupt changes in web quality during carding.

Briefly, the invention provides a grinding device for the clothing of a carding machine element which is able to operate continuously during operation of the carding machine element. For example, the grinding device may be operated from the time when a fresh clothing is put into service until replaced by new clothing. Thus, the slow falling off in web quality which occurs in previously known methods and the abrupt improvement in quality after a grinding process are eliminated.

The grinding device comprises a support, at least one grinding member for grinding the teeth of a carding machine element which is mounted in the support for universal movement and means elastically biasing the grinding member outwardly of the support to engage the teeth of the carding machine element.

In one embodiment, the support may be sized to extend across the width of the carding machine element while the grinding member is movably mounted in the support in order to move longitudinally thereof in parallel to the carding machine element. In another embodiment, the support and grinding member may be mounted so as to be reciprocally moved across the carding machine elements.

In one embodiment, the grinding member may be mounted in the support by suitable means for pivoting about two perpendicularly disposed axes. In this embodiment, the means for elastically biasing the grinding member biases the member along a third axis perpendicular to the two aforesaid axes whereby the grinding member has three degrees of freedom of movement. In one case, the grinding member may be in the form of a grindstone which is mounted by way of a ball joint on one end of a shaft which is slidably mounted in the support. In addition, the biasing means is in the form of a spring. Alternatively, the biasing means may be in the form of an elastic tube which may be filled with a pressurized fluid in order to bias the shaft on which the grindstone is mounted out of the support.

In another embodiment, a plurality of grinding members may be mounted on a common axis longitudinally of the support.

In still another embodiment, the support may be in the form of an elongated trough having an open side while a grinding member is in the form of a flexible member secured over the open end of the support in hermetically sealed manner. In this embodiment, the biasing means is in the form of an elastic tube which can be filled with pressurized fluid in order to bias the flexible member outwardly of the support.

These and other objects and advantages of the invention will become more apparent from the following detailed description taken in conjunction with the accompanying drawings wherein:

FIG. 1 diagrammatically illustrates a grinding device according to the invention applied to a carding machine;

Figure 1:
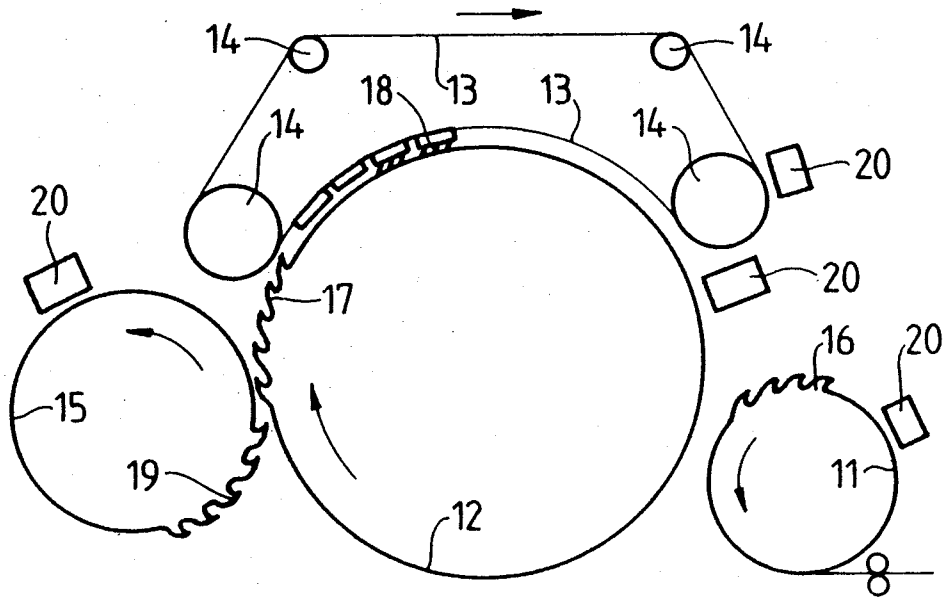

Referring to FIG. 1, the carding machine comprises a plurality of elements, such as a licker-in 15, which delivers textile fibers to a cylinder 12, a revolving flat chain 13 which is trained over reversing rollers 14 and a doffer 11. The direction of movement of the elements is indicated by arrows and carding takes place between the cylinder 12 and the chain 13 while the resulting web is transferred to the doffer 11 and conveyed away.

The cylindrical outer surfaces of the elements 11, 12, and 15 and those surfaces of the individual flats of the chain 13 which are directed towards the cylinder 12 are, of course, provided with teeth, which form sets of clothing 16, 17, 19, 18 respectively. These sets of clothing may consist of rigid teeth or teeth forming a flexible clothing.

At least one, or some, or all of the sets of clothing 16–19 are continuously subjected to a grinding operation during operation via grinding means 20, one such grinding device 20 being associated with each of the elements 11, 12, 13 and 15.

The grinding device 20 may be of various constructions. Some examples of such forms of construction are shown in FIGS. 2 to 5.

Figure 2:
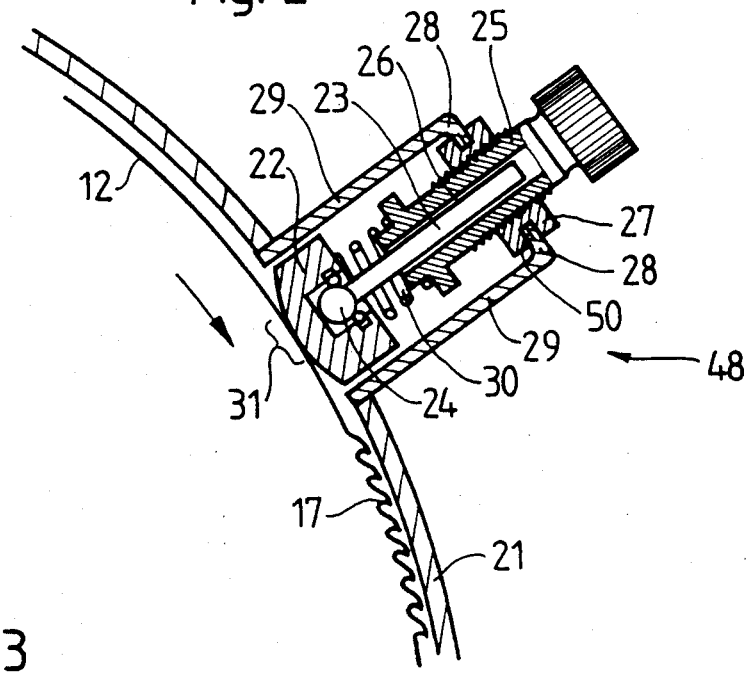
FIG. 2 illustrates a sectional view through one embodiment of a grinding means according to the invention.

The example of the grinding device is shown in FIG. 2 will be explained with reference to the element formed by the cylinder 12. This Figure shows only part of the cylinder 12 and the clothing 17. The axis of rotation of the cylinder 12 is perpendicular to the drawing plane and is situated outside FIG. 2. The cylinder 12 is provided with a cylinder cover 21 to form a hermetic arrangement.

The grinding means 48 comprises a support having a pair of parallel side walls and a grinding member 22 which is mounted between the walls 29. This grinding member 22 is in the form of a grindstone borne by a shaft 23 having a ball joint 24 at one end. A screwthreaded guide member 25 provided with a knob is formed with a cylindrical aperture 26 in which the shaft 23 is mounted for displacement. The guide member 25 is screwed on a cradle 27, which is adapted to reciprocate along rails 28 in a direction perpendicular to the drawing plane. The rails 28 are formed by bent strips of the walls 29 at the sides remote from the clothing 17.

The side walls 29 are of rectangular elongate shape and extend with their longitudinal edges parallel to the axis of rotation of the cylinder 12. The longitudinal edges of the walls 29 remote from the rails 28 are in the immediate vicinity of the clothing 17.

A means in the form of a compression spring 30 is disposed between the guide member 25 and the grindstone 22 to elastically bias the grindstone 22 against the clothing 17 and tends to position the grindstone 22 in its predetermined elastically biased position shown in FIG. 2. This biasing generally exerts a very light pressure of, for example 10 to 20 grams. The pressure is adjustable by rotation of the knob of the member 25. The grindstone 22 is held movably by the ball joint 24.

When the carding machine is in operation, the cylinder 12 is continuously rotating and at the same time the cradle 27 and hence the guide member 25 with the support 23 and the stone 22 are continuously reciprocated along the rails 28 via suitable means (not shown). As a result, the teeth of the clothing 17 are subjected to a grinding process during operation, thus eliminating the above-mentioned downtimes required for grinding the teeth and the periodic changes of the sharpness of the points of the teeth.

The ball joint 24 enables the grinding zone 31 of the grinding member 22 to be moved substantially in the direction of movement of the clothing 17 and in the direction perpendicular thereto and parallel to the axis of rotation of the cylinder 12. The shaft 23 slidably mounted in the aperture 26 also enables the grinding member 22 to move in a direction perpendicular to the clothing 17 at the grinding zone 31. Thus, the grinding zone 31 can move in three directions at right angles to one another, i.e. the grinding zone 31 has three degrees of freedom of movement and therefore adjusts, during grinding, to any irregularity in the clothing surface defined by the points of the teeth.

The attempt is made to so construct the clothing 17 that all the points of the teeth are at exactly the same level, i.e. they define an exact circular cylindrical generated surface, the axis of which coincides with the axis of rotation of the cylinder 12. In practice, however, minor deviations from such construction are inevitable. In particular, the deviations may comprise zones of considerable point heights and zones of relatively small point heights. The three degrees of freedom of movement of the grindstone 22 enables the grindstone 22 to adjust to these irregularities so that all the teeth are subjected to practically the same degree of grinding.

The use of the grinding device 48 shown in FIG. 2 is not restricted to the cylinder 12 but may also be applied to the licker-in 15, the revolving flat chain 13 and the doffer 15.

To obtain a gentle grinding operation, the side of the grindstone 22 which faces the clothing 17 may be of a shape similar to a hemisphere.

In carding, it is particularly important that the operation should not be impaired by disturbing air movements. The cylinder 12 is therefore provided with the cover 21. To enable the grinding device 48 to be installed, the cover 21 must have an opening as shown in FIG. 2, extending axially over the entire clothing 17. The grinding device 48 is disposed hermetically above this zone. To provide a hermetic seal to the device 48 itself, the walls 29, are provided with end walls (not shown) disposed perpendicularly to their longitudinal direction. Also, the cradle 27 is driven by a drive belt (not shown) which covers the open part between the rails 28 remote from the cylinder 12. Each of the rails 28 is formed with a slot 50 in each of which one longitudinal side of the driving belt is slidably mounted. Thus the walls 29 together with the end walls, the driving belt and the cradle 27 form a trough-shaped structure which is externally sealed off from the clothing 17.

In the case of the grinding device 48 shown in FIG. 2, the grindstone 22 is continuously reciprocated above the clothing. If this lateral movement is not required, a grinding device of the kind shown in FIG. 3 or FIGS. 4 and 5 may be provided, such device extending axially over the entire clothing.

Figure 3:
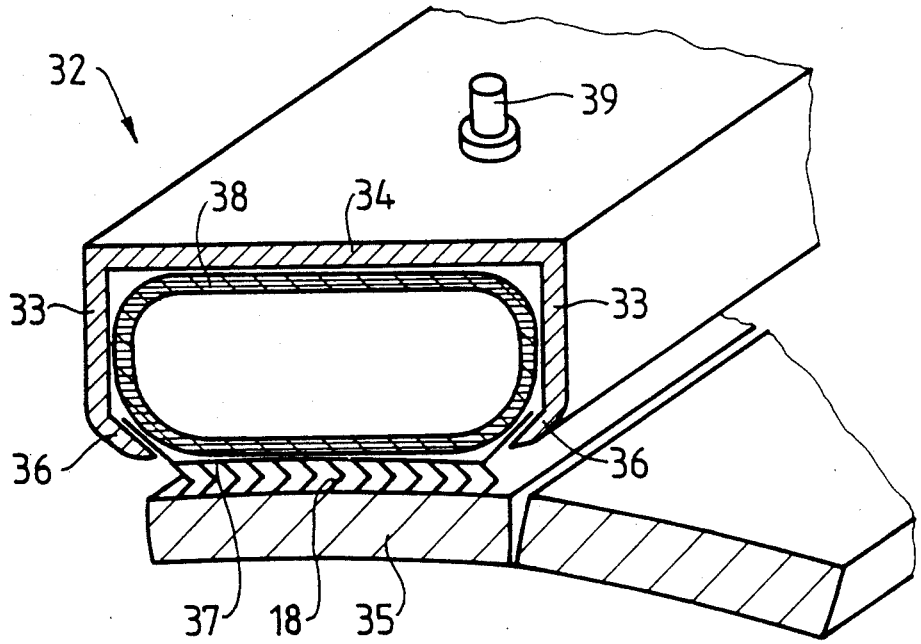
FIG. 3 illustrates a sectional view of another embodiment of a grinding means.

Referring to FIG. 3, the grinding device 32 is constructed for use at the revolving flat chain forming the element 13. The grinding device 32 comprises a trough-shaped support having two side walls 33 and a top plate 34. The free edges 36 of the walls 33 extend parallel to each revolving flat 35 at the grinding device 32, and perpendicularly to the direction of movement of the clothing 18. A grinding member 37 in the form of a flexible belt is fixed to the free edges 36 and extends longitudinally of the flat 35 (perpendicularly to the drawing plane) over the entire length of the flat 35. At its side facing the flat 35, the member 37 has a grinding coating consisting, for example, of fine abrasive particles, more particularly diamond powder. The member 37 may, for example, be a thin metal strip, a cloth, or a plastic with an abrasive coating which adjusts to local irregularities, i.e. the geometric shape of the surface defined by the points of the clothing teeth, but is not deformed by the grinding forces. In addition, the member 37 must not crease.

A biasing means in the form of a tube 38 of elastic material closed at both ends extends inside the trough-shaped support 33, 34 over the entire length thereof. The tube 38 can be filled with a fluid at a predetermined pressure by means of a valve 39 extending from the support.

In operation, the tube 38 exerts the same pressure at every point of the flexible member 37. The member 37 is thus pressed against the flat 35 over its entire length and therefore bears on the clothing 18 uniformly by its abrasive coating. Consequently, even in the event of irregularities in the height of the points of the teeth of the clothing 18, the member 37 is in uniform contact over the entire length of the flat 35. This is because the zones of the member 37 which move in an elevation or depression can perform their movement only if zones adjacent those zones simultaneously perform movements having a component parallel to the member 37, i.e., a horizontal component in the case of FIG. 3. It will therefore be clear that the possibility of the grinding surface of the member 37 moving in three directions at right angles to one another, i.e. the presence of three degrees of freedom of movement of the grinding means, is an important feature.

The grinding device 32 is also suitable for grinding each of the elements 11, 12 and 15.

Figure 4:
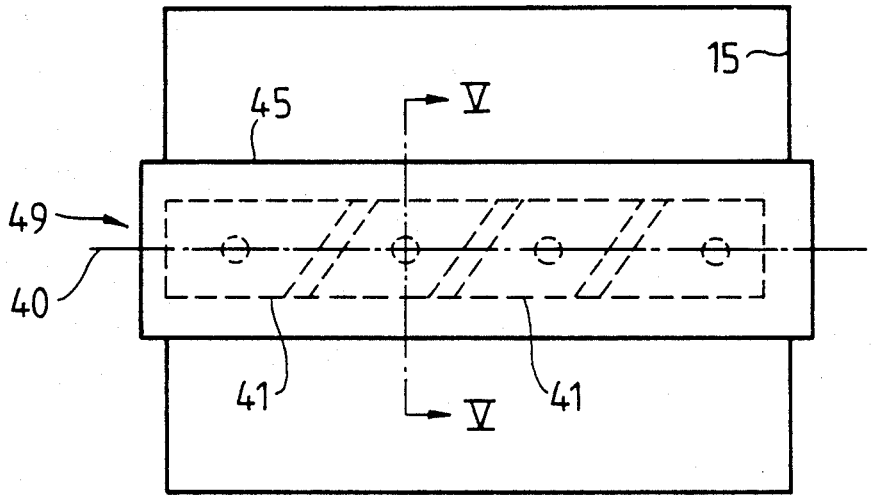
FIG. 4 illustrates a plan view of yet another embodiment.
Figure 5:
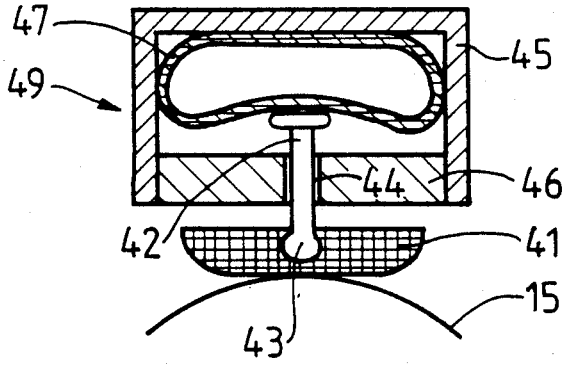
FIG. 5 illustrates a view taken on line V—V in FIG. 4.

FIGS. 4 and 5 relate to yet another embodiment of a grinding device 49 which is used at the doffer 11 but which can also be used for the elements 12, 13 or 15. The grinding device 49 extends over the entire length or the entire axial extent of the clothing of the doffer 11 rotatable about an axis 40. To perform the grinding process, the grinding device 49 comprises a plurality of grindstones 41 distributed axially along a common axis over the entire length. In a similar arrangement to FIG. 2, each stone 41 is borne by a shaft 42 by means of a ball joint 43 and is guided for displacement in a cylindrical aperture 44 of a guide plate 46 secured to a trough-shaped support 45. As in the example shown in FIG. 3, uniform biasing for the grinding stones 41 is produced by an elastic tube 47 filled with a fluid at a predetermined pressure.

When the arrangement shown in FIGS. 4 and 5 is in operation, each of the stones 41 again adjusts to any irregularities in the height of the points of the teeth, the stones 41 rocking by means of the ball joint 43 in response to any elevations or depressions, or by the shafts 42 sliding in the apertures 44. Thus, there are again three degrees of freedom of movement for each grinding zone of the stones 41.

When the stones 41 are in their middle operating position there must be a gap between the individual grindstone 41. For this reason, with rectangular stones, some teeth moving over such a gap during their rotation are not ground. This is obviated by the provision of trapezoidal grinding stones 41 as shown in FIG. 4. Of course embodiments are possible with grinding stones staggered relative to one another in the direction of movement of the clothing.

The movement of the revolving flat 13 is of course relatively slow. If the grinding operation is inadequate for that reason, it can be increased in the case of grindstones of the kind shown, for example, in FIG. 2 or FIGS. 4 and 5 by additionally oscillating or vibrating the stones. Where a tube 38 or 47 is used, of course, the grinding effect can be varied by varying the pressure in the tube and by vibrating the same.

The invention thus provides a grinding device which is capable of operation while in place on an operating carding machine. In addition, the invention provides a grinding device which is able to adjust to variations in the radial extent of the teeth of a clothing in order to grind the teeth equally and to the same extent.

What is claimed is:

1. A grinding device for the clothing of a carding machine element, said device comprising a support;

at least one grinding member for grinding the teeth of a carding machine element, said member being mounted on said support with three degrees of freedom of movement; and means elastically biasing said grinding member outwardly of said support to engage the teeth of a carding machine element.

2. A grinding device as set forth in claim 1 wherein said support is sized to extend across the width of the carding machine element and said grinding member is movably mounted in said support to move longitudinally thereof in parallel to the carding machine element.

3. A grinding device as set forth in claim 1 wherein said grinding member is a grindstone.

4. A grinding device as set forth in claim 1 wherein said grinding member is a flexible belt having a grinding coating thereon.

5. A grinding device as set forth in claim 1 comprising a plurality of said grinding members mounted on said support along a common longitudinal axis.

6. A grinding device for the clothing of a carding machine element, said device comprising a support;

at least one grinding member for grinding the teeth of a carding machine element;

first means mounting said grinding member in said support for pivoting about two perpendicularly disposed axes; and second means elastically biasing said grinding member outwardly of said support along a third axis perpendicular to said two axes whereby said grinding member has three degrees of freedom of movement.

7. A grinding device as set forth in claim 6 wherein said grinding member is a grindstone.

8. A grinding device as set forth in claim 6 wherein said first means includes a shaft slidably mounted in said support and a ball joint mounting said grinding member on one end of said shaft.

9. A grinding device as set forth in claim 8 wherein said first means is slidably mounted in said support to move longitudinally thereof.

10. A grinding device as set forth in claim 6 wherein said grinding member is hermetically sealed relative to said support.

11. A grinding device as set forth in claim 6 wherein said grinding member has a hemispherical grinding surface.

12. A grinding device as set forth in claim 6 wherein said second means is a spring.

13. A grinding device as set forth in claim 6 wherein, said second means is an elastic tube for holding pressurized fluid therein.

14. A grinding device as set forth in claim 6 wherein said first means includes a shaft slidably mounted in said support and a ball joint mounting said grinding member on one end of said shaft and wherein said second means is an elastic tube for holding pressurized fluid therein, said tube being disposed to bias said shaft outwardly of said support.

15. A grinding device as set forth in claim 14 comprising a row of said grinding members.

16. A grinding device as set forth in claim 15 wherein each grinding member is of trapezoidal shape to form an overlapping grinding zone with an adjacent grinding member.

17. A grinding device for the clothing of a carding machine element, said device comprising an elongated support of trough shape having an open side;

a flexible grinding member secured to and extending across said open side of said support in hermetically sealed relation for movement in three directions at right angles to one another; and means elastically biasing said grinding member outwardly of said support.

18. A grinding device as set forth in claim 17 wherein said means is an elastic tube for holding pressurized fluid therein.

19. In combination, a carding machine element having a clothing of teeth thereon; and a grinding device for grinding said clothing, said device including a support having a pair of side walls extending in close relation to said clothing, a grinding member mounted on said support and between said side walls for a movement therebetween having three degrees of freedom, and means biasing said grinding member out of said support towards said machine element for grinding of said clothing.

20. A grinding device as set forth in claim 19 wherein said support is reciprocally movable across said clothing.

21. A grinding device as set forth in claim 20 wherein said grinding device extends across the width of said clothing.

22. A grinding device as set forth in claim 20 which further comprises a cover having an opening receiving said side walls of said grinding device in sealed relation, said cover extending over said clothing in spaced relation to form a hermetic cover therefor.

23. A method of grinding the clothing of a carding machine element comprising the steps of positioning a grinding device having a grinding member mounted therein for movement in three directions at right angles to one another over a carding machine element having a clothing of teeth thereon; and biasing the grinding member towards the carding machine element during operation of the element to effect grinding of the clothing thereof while continuously adjusting to the shape of the generated surface of the tips of the teeth of the clothing.

* * * * *

UNITED STATES PATENT AND TRADEMARK OFFICE

CERTIFICATE OF CORRECTION

PATENT NO. : 4,984,395

DATED : January 15, 1991

INVENTOR(S) : ROBERT DEMUTH

It is certified that error appears in the above-identified patent and that said Letters Patent is hereby corrected as shown below:

Column 3, lines 42-43 change "screwth-readed" to -screw-threaded-
Column 4, line 46 change "29, are" to -29 are-
Column 7, lines 6 to 7 change "wherein, said" to -wherein said-

Signed and Sealed this

Twenty-first Day of July, 1992

*Attest:*

DOUGLAS B. COMER

*Attesting Officer*

*Acting Commissioner of Patents and Trademarks*